United States Patent [19]

Zeigler et al.

[11] 4,212,403

[45] Jul. 15, 1980

[54] DRAPERY HANGER

[76] Inventors: Michael R. Zeigler, 1125 Maple Ave.; Robert P. Zeigler, 6675 Quail Ridge La.; Bert A. Zeigler, 1333 Maple Ave., all of Fort Wayne, Ind. 40802

[21] Appl. No.: 881,377

[22] Filed: Feb. 27, 1978

[51] Int. Cl.[2] ..... A47F 7/16

[52] U.S. Cl. ..... 211/119; 223/91

[58] Field of Search ..... 211/113-119, 211/123, 124, 13; 223/85, 91, 96; 24/204; 206/326

[56] References Cited

U.S. PATENT DOCUMENTS

| | | | |
|---|---|---|---|
| 987,416 | 3/1911 | Tueckmantel | 223/91 |
| 2,164,534 | 7/1939 | Luhn | 223/85 |
| 2,503,648 | 4/1950 | Zeigler | 211/119 |
| 3,640,273 | 2/1972 | Ray | 24/204 X |
| 3,866,809 | 2/1975 | James | 211/119 X |
| 3,942,636 | 3/1976 | Matsuyama et al. | 24/204 X |
| 3,967,766 | 7/1976 | Hart | 211/113 X |
| 3,994,048 | 11/1976 | Rosenthal | 24/204 X |

FOREIGN PATENT DOCUMENTS

| | | | |
|---|---|---|---|
| 413259 | 5/1925 | Fed. Rep. of Germany | 211/113 |

*Primary Examiner*—Roy D. Frazier
*Assistant Examiner*—Robert W. Gibson, Jr.
*Attorney, Agent, or Firm*—David A. Lundy

[57] ABSTRACT

A drapery hanger comprising a hanger member having a neck portion and a pair of arms connected thereto extending in opposite directions from the neck portion. Two adjustable collars are connected to and supported by these arms. These adjustable collars are capable of holding draperies just below the pleated portions thereof when folded in an accordion fashion. The hanger member can be supported by a horizontal rod or the like so that the draperies connected thereto depend therefrom and are maintained in a wrinkle free condition.

7 Claims, 2 Drawing Figures

DRAPERY HANGER

BACKGROUND OF THE INVENTION

The field of the invention relates to hangers, and more particularly, that of hangers for holding drapes.

In general, a set of drapes comprises two drape members each having longitudinal folds defining pleats running the length thereof. Drapes manufactured from modern permanent press material such as polyesters are very popular and quite prevalent. These permanent press materials are of such a nature than when folded over a rod, a conventional hanger, or the like for any extended period of time, a semi-permanent crease is formed in the material. This crease usually may only be removed by subsequent pressing.

When drapes have been sent to a drapery cleaner and after the drapes have been professionally cleaned, they generally must be stored at the cleaner's establishment until picked up or delivered to the owner/customer. The prior art only provides for storing drapes by folding the drapes over a conventional hanger or a rod member.

In some cases the period of time that the drapes are stored is short; however, in a great number of cases, the period of storage is relatively long. As a consequence, in order that the drapes be of a suitable appearance to be hung, the cleaner may have to press the drapes immediately prior to delivery or pick up, or the owner/customer may have to press the drapes after delivery or pick up. It is readily apparent that the presence of these wrinkles and/or creases is detrimental to the appearance of the drapes and that it would be advantageous to provide a drapery hanger which would not lead to the creation of such wrinkles and/or creases.

SUMMARY OF THE INVENTION

It is an object of the invention to provide an improved drapery hanger.

It is another object of the invention to provide an improved drapery hanger by which draperies can be hung in a wrinkle free condition.

It is another object of the invention to provide an improved drapery hanger by which drapery materials can be stored and hung in a wrinkle free condition until picked up by the customer.

It is another object of the invention to provide a drapery hanger by which draperies made of modern permanent press materials can be hung in a wrinkle free condition for extended periods of time.

It is another object of the invention to provide an improved drapery hanger which can hold draperies without putting a transverse crease therein.

It is another object of the invention to provide an improved drapery hanger which eliminates the necessity of pressing drapes prior to delivery to a customer after being stored for an extended period of time.

And finally, it is an object of the invention to provide an improved drapery hanger which eliminates the necessity of a customer pressing draperies after receiving the same from an establishment at which they were stored for an extended period of time.

The invention in its broader aspects comprises a hanger member having a neck portion to which are connected a pair of arms extending in opposite directions therefrom. Two adjustable collars are connected to and supported by these arms. These adjustable collars are capable of holding draperies just below the pleated portions thereof folded in an accordion manner. The hanger member can be supported by a horizontal rod or the like with the draperies connected thereto depending therefrom in a wrinkle free condition.

BRIEF DESCRIPTION OF THE DRAWINGS

The above-mentioned and other features and objects of this invention and the manner of attaining them will become more apparent and the invention itself will be best understood by reference to the following description of the invention taken in conjunction with the accompanying drawings wherein.

DESCRIPTION OF A SPECIFIC EMBODIMENT

Figure 1:
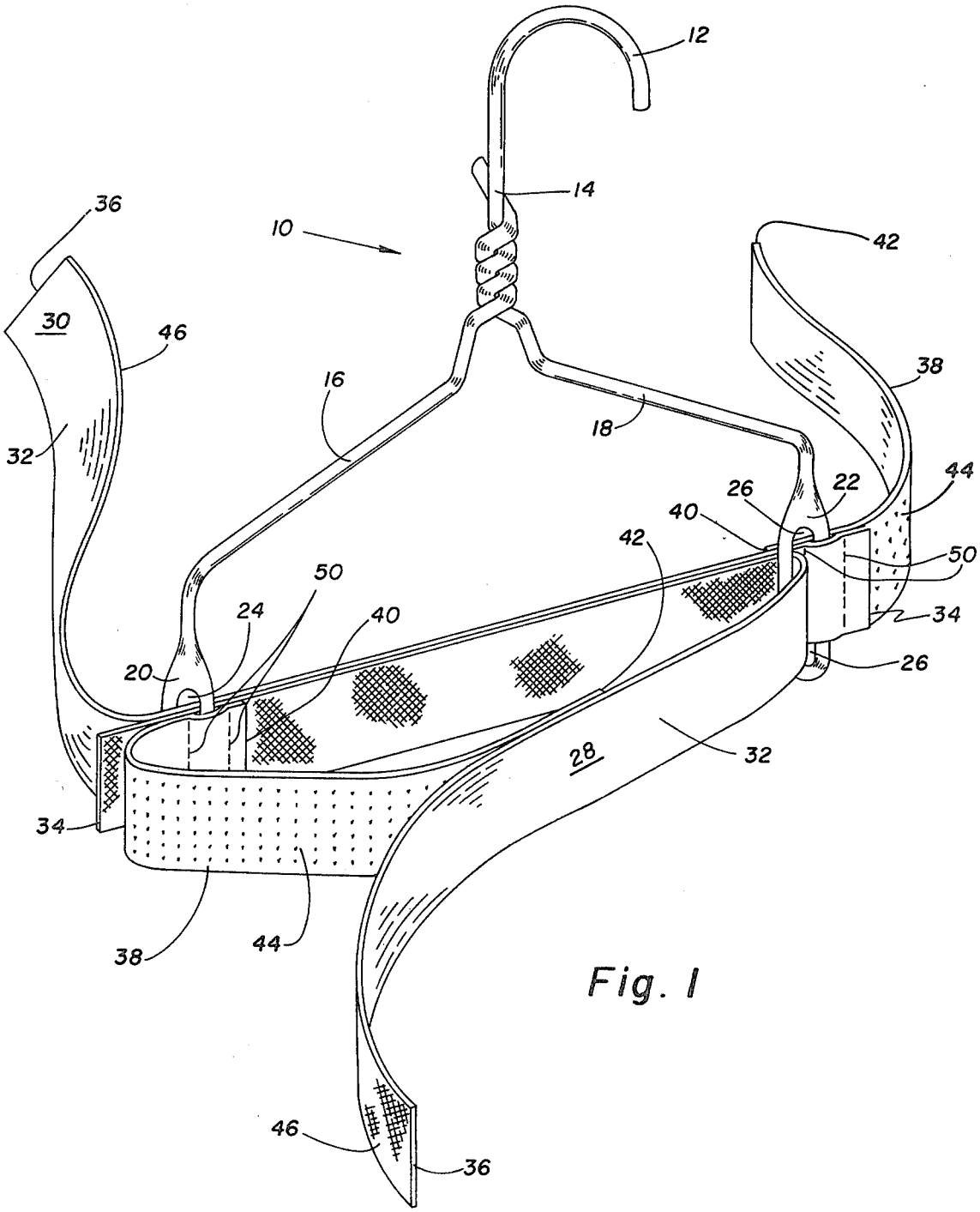
FIG. 1 is a perspective view of the drapery hanger of the invention.

Referring to FIG. 1, hanger 10 is comprised of a hook portion 12 and a neck portion 14. Neck portion 14 depends from hook portion 12 a pair of arm members 16 and 18 are connected to neck portion 14 and extend in opposite directions therefrom. Arms 16 and 18 have distal ends 20 and 22, respectively. In the specific embodiment illustrated, hanger member 10 is formed of relatively stiff wire material. Distal ends 20 and 22 respectively, have apertures 24 and 26 therein.

Distal ends 20 and 22 support two elongated drapery collars 28 and 30 which pass through apertures 24 and 26. Collars 28 and 30 loop around and are fastened in an end to end relation so as to be able to maintain a drape within the circumference of each collar 28, 30. Generally speaking, collars 28 and 30 may be of any flexible type of cord, band, tie, bolt, strap, or the like which is capable of being fastened by tying or by conventional fasteners affixed thereto such as snaps, hooks, buttons, buckles, or the like in a manner such that the collars may be adjusted to various circumferential lengths and securely fastened around a drape, as will be described in more detail hereinafter or any flexible and resilient type of cord, band, strap, belt or the like which can be expanded to various circumferential lengths and simarly fastened around a drape, provided that the material of collars 28, 30 and the fasteners, if any, are sufficiently strong to support the weight of a drape.

In the specific embodiment illustrated, both collars 28 and 30 are of a two piece construction of hook and pile material such as sold commercially under the trademark "VELCRO" by the Velcro Corporation, New York, New York. Since collars 28 and 30 are identical, a description of one will suffice for the other. In this description, like reference numerals will be used to indicate like structure. Collars 28 and 30 each comprise a long strap 32 having opposite ends 34 and 36, and a short strap 38 having opposite ends 40 and 42. Being of hook and pile material straps 32, 38 include a fastening device comprising oppositely facing mating surface 44 being formed of hook material and surface 46 being formed of pile material, which when placed in a facing relationship and pressed together are removably connected together in a secure manner.

Straps 32 and 38 are connected together adjacent ends 34 and 40 respectively with surface 44 of strap 38 facing surface 46 of strap 32. In order to make this connection relatively permanent, and to attach the collars 28 to hanger 10, strap 32 of collar 28 adjacent end 34 is threaded through the aperture 24, strap 38 is stitched at 50 to strap 32 on both sides of distal end 20 as shown in FIG. 1. Strap 32 of collar 28 adjacent end 36 is threaded through the aperture 26 and is supported by distal end 22. In order to attach collar 30 to hanger 10, strap 32 of collar 30 is threaded through aperture 26, strap 38 is stitched at 50 to strap 32 on both sides of distal end 22. Strap 32 of collar 30 adjacent end 36 is threaded through aperture 24 and is supported by distal end 20. The relatively positioning of surfaces 44, 46 of straps 38, 32, respectively is such that straps 32 and 38 may be detachably connected at various circumferential lengths adjacent to ends 36 and 42 by merely positioning straps 32, 38, as desired, with surfaces 44, 46 facing each other and pressing straps 32, 38 together. Straps 32, 38 can be repeatedly pulled apart and secured together and the hanger 10 can be used over and over again.

In operation, a conventional set of draperies can be hung in a wrinkle free condition from the improved drapery hanger 10 of the invention and stored for considerable length of time without creating wrinkles or creases therein, or otherwise disturbing the longitudinal pleats therein. Since a conventional set of drapes comprise two individual drapes 52, the improved drapery hanger of the invention having paired collars 28 and 30 can store a complete set of drapes.

Figure 2:
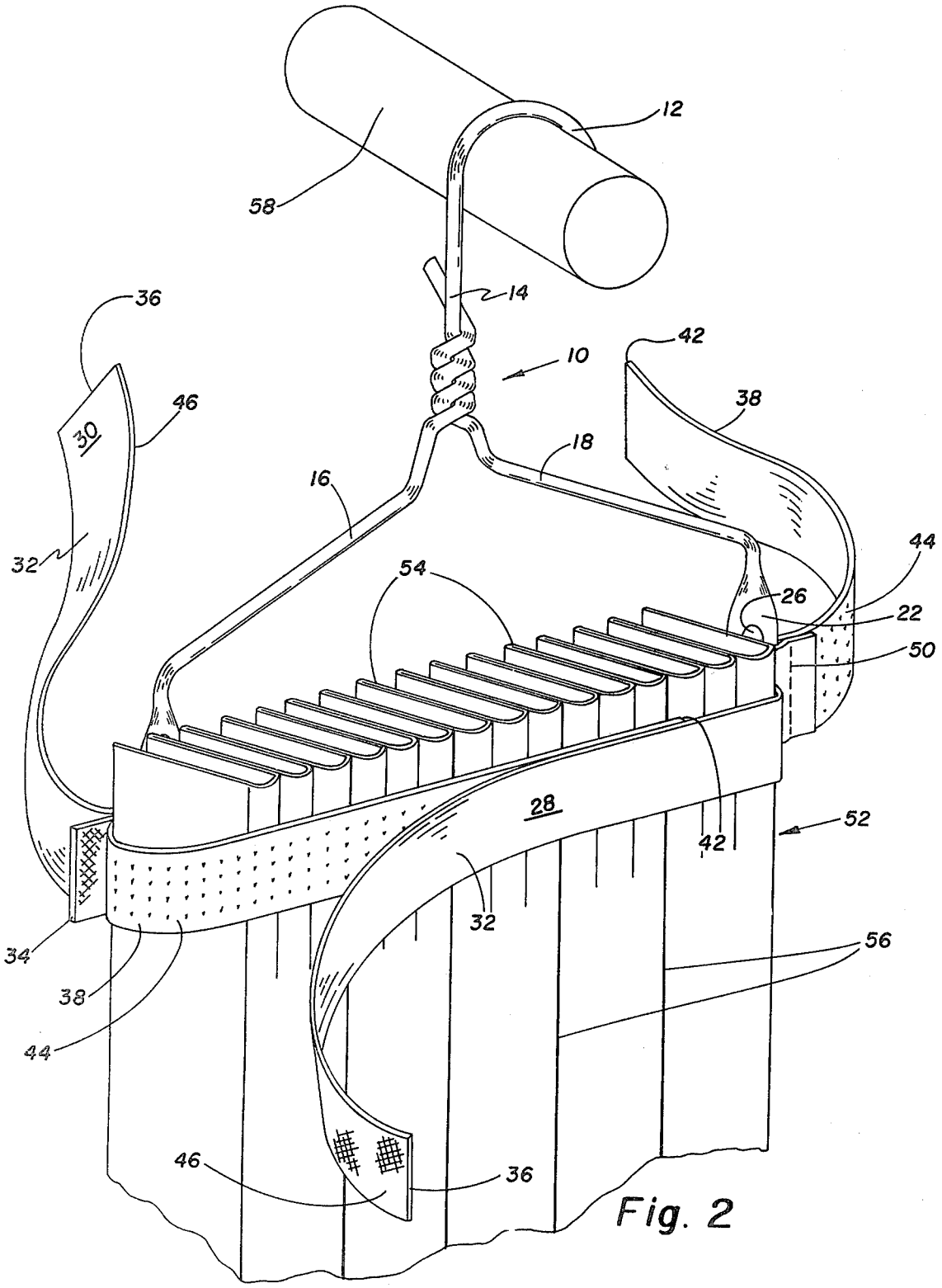
FIG. 2 is a perspective view of the drapery hanger of the invention illustrating a drape hung thereby.

Referring to FIG. 2, drape 52 has a plurality of accordion pleats 54 at the top end thereof, and a plurality of longitudinal pleats 56 traveling from the bottom of accordion pleats 54 to the bottom of drape 52. To hang a drape 52 on hanger 10, drape 52 is positioned in one of adjustable collars 28, 30 with the collar located just below pleats 54 properly folded in an accordion fashion, and the collar is drawn relatively tightly around drape 52 and fastened as above-described. This may be repeated for the second drape 52. The improved drapery hanger 10 can then be suspended from a rod 58 so that the drapes depend freely downward in a wrinkle free condition.

The manner of suspension, when hung as described above, is very similar to the manner by which the drapes are hung in place. While the collars 28, 30 hold the drapes 52 relatively tightly, the drapes are held in the same way they are pressed. Thus, drapes may be stored in a wrinkle free condition for extended periods of time by the invention.

The invention provides an improved drapery hanger by which draperies of all types can be hung in a wrinkle free condition. Since many times a customer having draperies cleaned or purchasing new draperies will not pick them up from the cleaners or manufacturers on time, draperies need to be stored for extended periods of time. Draperies hung by the improved drapery hanger of the invention completely eliminates the necessity of a commercial cleaner or drapery manufacturer pressing draperies just prior to pick up.

While there have been described above the principles of this invention in connection with specific apparatus, it is to be clearly understood that this description is made only by way of example and not as a limitation to the scope of the invention.

What is claimed is:

1. A drapery hanger comprising a hanger member having a pair of arms extending in opposite directions, a pair of collars each being adjustable to a plurality of different circumferential lengths, means connecting said collars to said arms, said collars being supported by said arms, said collars each comprising an elongated and flexible element having opposite ends, and means for fastening said opposite ends together at various positions, said hanger member being between said collars, said collars opening in opposite directions from said hanger, said hanger member being sufficiently strong to bear the weight of at least one pair of drapes, each of said collars being sufficiently strong to bear the weight of at least one drape.

2. The hanger member of claim 1 wherein said collar is a resilient and flexible strap.

3. The drapery hanger of claim 1 wherein said fastening means includes hook and pile material fasteners.

4. The drapery hanger of claim 1 wherein said hanger member has a hook portion and a neck portion, said neck portion having opposite ends, one of said neck portion ends being connected to said hook portion, the other of said neck portion ends being connected to said arms, each of said arms has a distal end, said connecting means including an aperture in both of said distal ends, said collars passing through said apertures and being supported by said arms.

5. The drapery hanger of claim 4 wherein said fastening means includes two elongated pieces of material, one of said pieces being of hook material, the other of said pieces being of pile material, said one and other pieces having a surface of hook and pile construction, respectively, which when positioned with said surfaces facing each other and pressed together are removably secured together, one of said pieces being longer than the other, said one piece being positioned in said aperture of said arms, both said longer piece and said shorter piece having opposite ends, one end of said shorter piece being connected to one end of said longer piece, both said pieces being connected to said drapery hanger whereby said pieces adjacent said other ends thereof may be removably fastened together at various circumferential lengths of said collar.

6. The drapery hanger of claim 1 wherein said hanger member is formed of relatively stiff wire material.

7. A drapery hanger comprising a hanger member having a pair of arms extending in opposite directions, at least one collar being adjustable to a plurality of different circumferential lengths, means connecting said collar to said arms, said collar being supported by said arms, said collar being flexible, said hanger member being self-supporting, said hanger member and collar being sufficiently strong to bear the weight of at least one drape, said collar comprises an elongated and flexible element having opposite ends, and means for fastening said opposite ends together at various positions, said hanger member having a hook portion and a neck portion, said neck portion having opposite ends, one of said neck portion ends being connected to said hook portion, the other of said neck portion ends being connected to said arms, each of said arms having a distal end, said connecting means including an aperture in both of said distal ends, said collar passing through said apertures and being supported by said arms, said fastening means includes two elongated pieces of material, one of said pieces being of hook material, and other of said pieces being of pile material, said one and other pieces having a surface of hook and pile construction, respectively, which when positioned with said surfaces facing each other and pressed together are removably secured together, one of said pieces being longer than the other, said one piece being positioned in said apertures of said arms, both said longer piece and said shorter piece having opposite ends, one end of said shorter piece being connected to one end of said longer piece, both said pieces being connected to said drapery hanger whereby said pieces adjacent said other ends thereof may be removably fastened together at various circumferential lengths of said collar.

* * * * *